United States Patent [19]

Jones

[11] Patent Number: 4,804,092

[45] Date of Patent: Feb. 14, 1989

[54] NESTABLE CONTAINER

[75] Inventor: Wilfred L. Jones, Hereford, England

[73] Assignee: Imperial Chemical Industries PLC, London, England

[21] Appl. No.: 598,594

[22] Filed: Apr. 10, 1984

[30] Foreign Application Priority Data

Apr. 22, 1983 [GB] United Kingdom ..... 8311027

[51] Int. Cl.[4] ..... B65D 21/02; B65D 21/04; B65D 25/28

[52] U.S. Cl. ..... 206/579; 206/506; 206/515; 206/518; 220/94 A; 229/125.17

[58] Field of Search ..... 206/503, 506, 508, 515, 206/518, 519, 520; 220/94 A; 229/43

[56] References Cited

U.S. PATENT DOCUMENTS

| | | | |
|---|---|---|---|
| 2,787,410 | 4/1957 | Moore | 229/43 |
| 3,169,659 | 2/1965 | Blackmore | 206/506 |
| 3,235,164 | 2/1966 | Anderson | 229/43 |
| 3,376,046 | 4/1968 | Kivett | 206/506 |
| 3,884,384 | 5/1975 | Cloyd | 220/94 A |
| 3,900,106 | 8/1975 | Candales | 220/339 |
| 4,177,896 | 11/1979 | Weavers | 220/94 A |
| 4,194,626 | 3/1980 | Boller | 206/509 |

FOREIGN PATENT DOCUMENTS

| | | | |
|---|---|---|---|
| 1164911 | 10/1958 | France | 206/506 |
| 7808592 | 2/1980 | Netherlands | 206/506 |
| 7903707 | 11/1980 | Netherlands | 206/506 |

*Primary Examiner*—George E. Lowrance

*Attorney, Agent, or Firm*—Cushman, Darby & Cushman

[57] ABSTRACT

A container which, when empty, is nestable within a like container and may be used to contain a structured paint or other material. The container comprises grippable (22), wall (20) and base (12) portions, the grippable portion (12) being integrally formed with the wall portion (20) and lying adjacent the wall portion (20) and extending within an outer like container in a nesting configuration. When not nested the grippable portion (22) is displaceable relative to the wall portion (20).

7 Claims, 5 Drawing Sheets

NESTABLE CONTAINER

The present invention relates to a nestable container, particularly to a container having a grippable portion which can serve as a handle.

According to the present invention there is provided a container comprising: a base portion; a wall portion extending upwardly from the perimeter of the base portion; and a grippable portion; characterised in that said grippable portion is integrally formed with the wall portion and has a nesting configuration in which it lies adjacent the exterior of the wall portion so that the container can nest within a like container with the grippable portion of the inner container extending within the outer container; and wherein when the container is not nested the grippable portion is displaceable relative to the wall portion.

By the term 'grippable portion' we mean a portion of the container which may be gripped by the hand. This grippable portion may have one or more of a variety of functions, for example it may serve as a handle or as a hanger for the container, or as an implement which may be detached for use with material which is contained within the container.

Also, according to this invention there is provided a nestable container comprising: a base portion; a wall portion extending upwardly from the perimeter of the base portion; and a handle portion; said handle portion being displaceable between a carrying configuration in which it extends outwardly away from the wall portion, and a nesting configuration in which it lies adjacent the exterior of the wall portion so that the container is nestable within a like container with the handle portion of the inner container extending within the outer container.

The term container describes a variety of equivalent constructions sometimes referred to by specific names such as tray or box.

Preferably the grippable, wall and base portions are formed integrally, suitably from an injection moulded plastics material. The grippable portion may have a line of weakness adjacent its connection to the tray, for example to permit movement between nesting and carrying configurations when the grippable portion constitutes a handle.

The container may have a generally rectangular base, with the wall portion providing four sides. The sides will generally not be at right angles to the base portion, but will extend upwardly and outwardly somewhat. To enable the container to stand "on end", there may be support means adjacent the interconnection of one or more sides (preferably comprising the side opposite to that bearing the grippable portion) and the base. Suitable formations provided adjacent to opposed edges of the base portion can also serve to facilitate stacking of filled trays, for example one on top of another, adjacent trays being turned through 90°.

Preferably the container has a lid with a peripheral channel engageable over an upper margin of the wall portion.

In one preferred form, the grippable portion constitutes a handle for the container, being hingedly displaceable to a carrying configuration in which it projects away from the wall portion. This grippable portion may have other or additional functions. Thus it may serve as a hanger for hanging a container (possibly containing a product and closed by a lid) from a display apparatus. The hanger may hinge in the same manner as the handle described above. In another type of embodiment at least a part of the grippable portion is arranged to be torn or broken free by a user, to provide an implement for use with material from the container. For example, a container intended for adhesive or plaster may be formed with a spreader (and/or patterner for providing a surface texture). This is formed integrally with the container, and does not prevent empty containers from being stacked at a high density.

Particularly when the grippable portion is to be hingeable, a particularly preferred material is polypropylene. This allows the formation of a flexing hinge which can endure very many flexings.

Preferred embodiments of the invention will now be described in greater detail with reference to the accompanying drawings in which.

Figure 6:
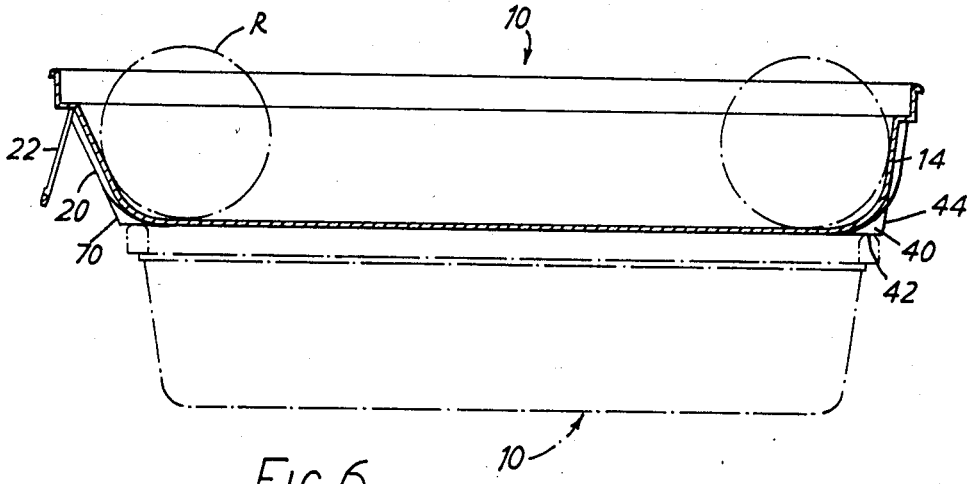
FIG. 6 is an elevation of two containers stacked without nesting.

The container shown in the Figures is intended as a paint container for use with a paint roller R (as shown in outline in FIG. 6). The container 10 has a generally rectangular base 12, from which walls 14,16,18,20 extend upwardly and outwardly. Three of the walls 14,16,18, are almost perpendicular to the base 12, e.g. diverging at angles of about 8°. The fourth wall 20 (one of the shorter walls) is at a greater angle, e.g. of 30° to the perpendicular. A carrying handle 22 (constituting the grippable portion) is fast with the wall 20 at an upper region thereof, and extends downwardly. The container 10 (comprising the base 12, walls 14–20 and the carrying handle 22) is integrally formed, suitably as a plastics moulding. It may be produced by injection moulding.

Figure 1:
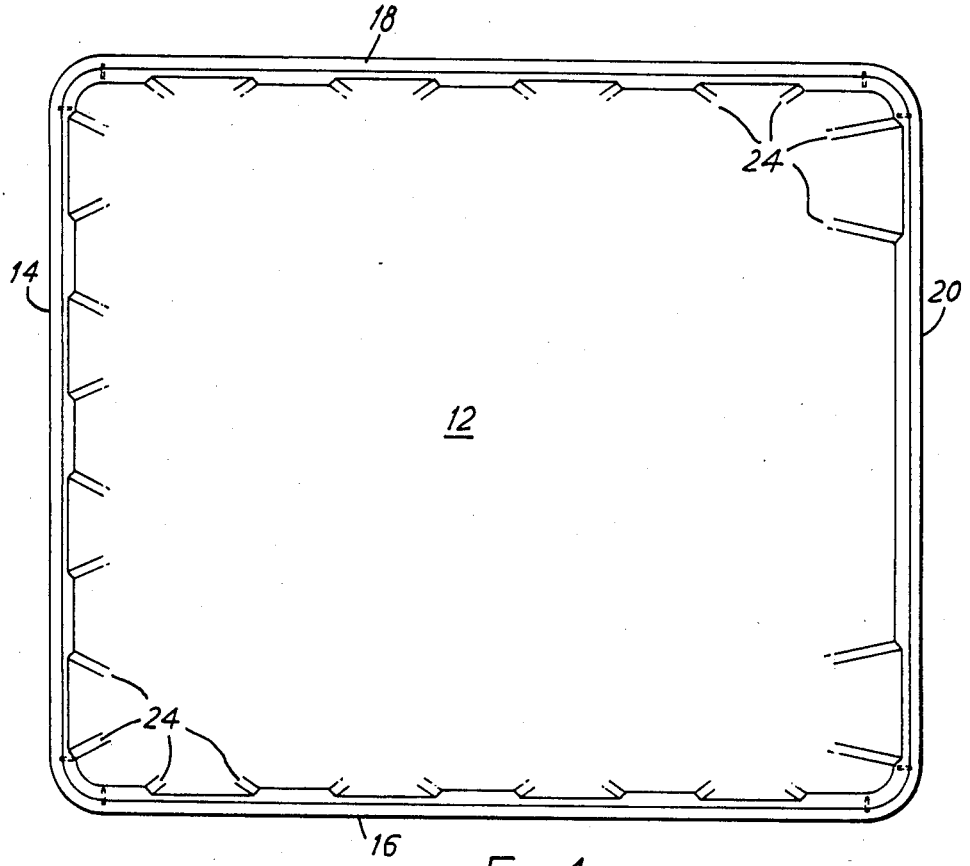
FIG. 1 is a plan of a container embodying the invention.
Figure 8:
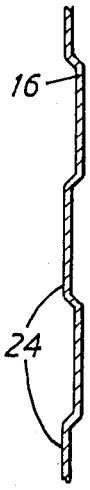
FIG. 8 is a longitudinal section through a wall portion showing the corrugation.

The walls are formed with corrugations 24 to provide strength. A suitable form of corrugation 24 is shown in FIG. 8. Generally there will not be corrugations in the region of connection of the handle 22 to the wall 20 (see FIG. 1.).

Adjacent the top of the walls, there is an outward step 26, above which there is a short upright wall portion 28 and then an enlarged, outwardly projecting, rim bead 30.

Figure 2:
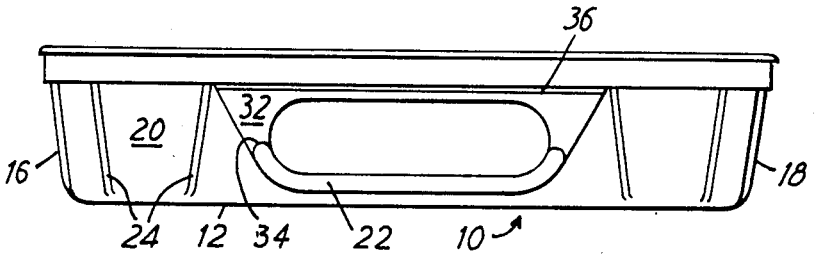
FIG. 2 is an elevation of the container from the end having the grippable portion.
Figure 3:
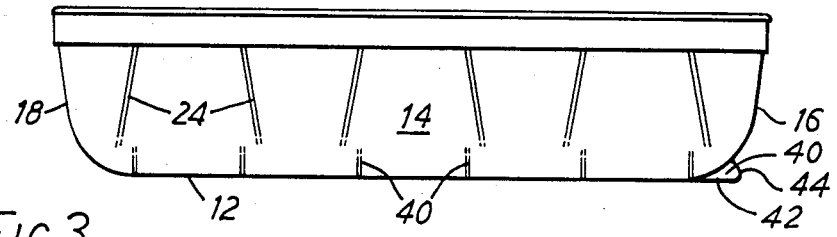
FIG. 3 is an elevation of the container from the opposite end.
Figure 5:
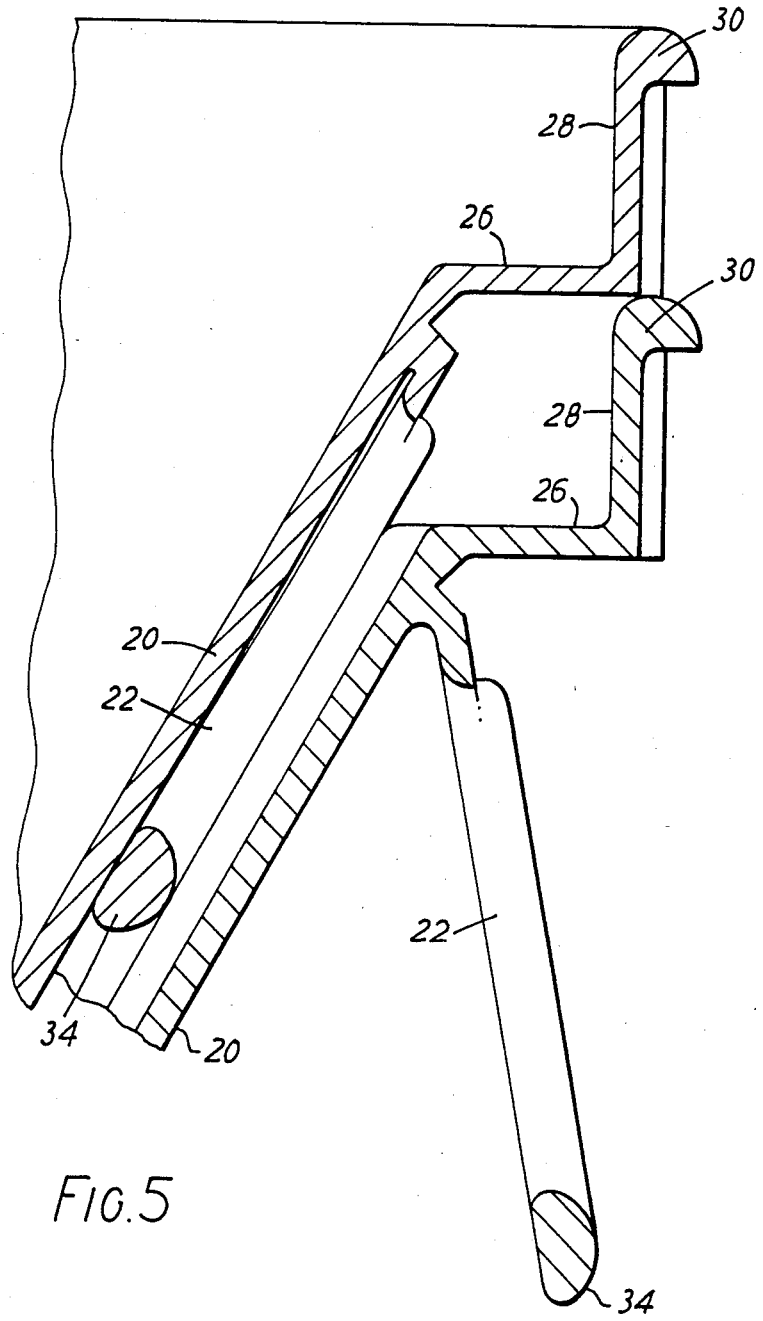
FIG. 5 is a like view but sectioned in the region of the grippable portions, and not showing lids.

As may be seen from FIGS. 2 and 5, the handle 20 is provided by an apertured web which is connected to a central portion of the wall 20 just beneath the step 26. The web 32 is generally of similar thickness to the walls. But the outer edge has a thickened rib 34, with rounded edges. There is a line of weakness 36 at the junction of the handle web 32 and the wall 20. This allows the web 32 to hinge to a position in which it lies against the outside of the wall 20, as shown for the upper tray in FIG. 5.

Figure 7:
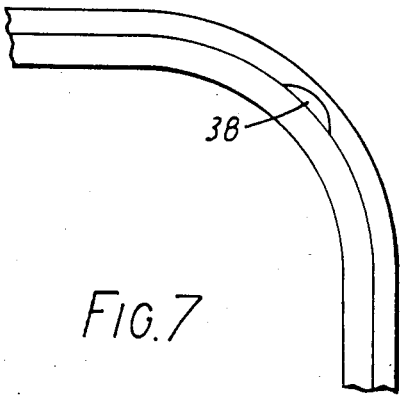
FIG. 7 is a fragmentary view of one container seen in the direction of the arrow VII in FIG. 4.

The corners of the container 10 (between adjacent walls) are rounded and, as shown in FIG. 7, have moulded pillars 38 which are semi-elliptical in section, and which extend downwardly for the length of the short upright wall portion 28 (FIG. 5).

The junctions of the walls, 14,16,18,20 with the base 12 are rounded. At the region of the junction of wall 14 (the wall opposite to the handle-carrying wall 20), there are a plurality of standing lugs 40 which project so as to define a relatively sharp corner. The lugs 40 define a base surface 42 which is continuous with the underside of the base 12; and a side surface 44 approximately at right-angles thereto.

Figure 4:
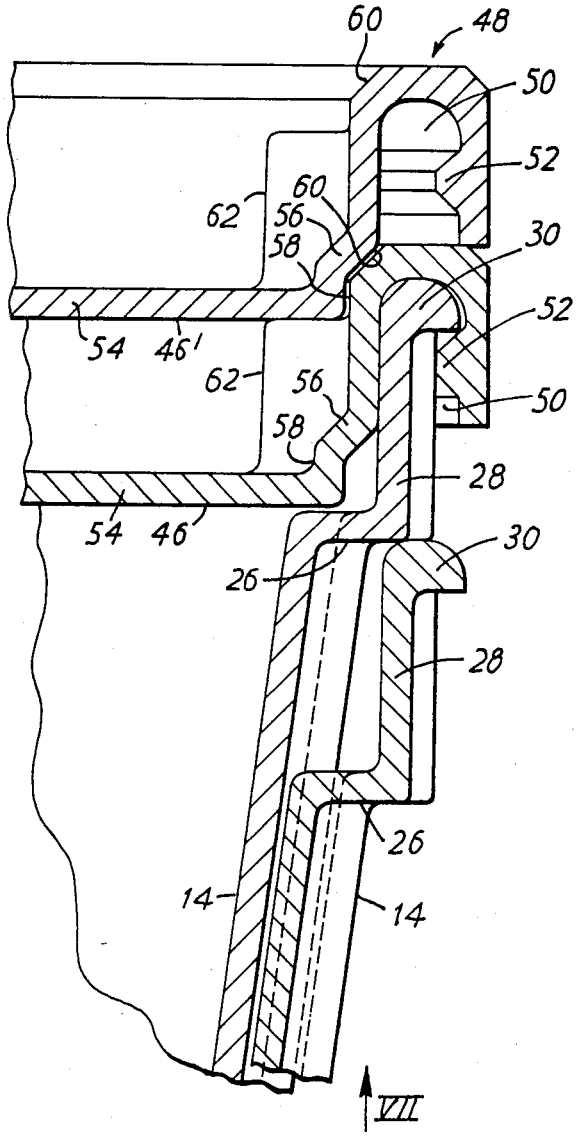
FIG. 4 is a detail of a vertical section through two nested containers and lids.

Manufactured containers may be nested together to reduce their bulk, for example for delivery to a customer. The manner of the nesting can be understood by reference to FIGS. 4 and 5. The containers 10 are all in the same orientation (i.e. all of the handles are at the same end). The walls 14,16,18 without handles nest as shown in FIG. 4; the underside of the step 26 of one container rests on the rounded upper surface of the rim bead 30 of the container beneath. (The lids 46, 46' will not generally be present). At the handle-bearing sides 20, the handles 22 of all but the bottom container are pressed against the walls 20 of the containers 10 to which they are attached. They are held in this nesting configuration (against their own resilience) by the inside surfaces of the walls 20 of the containers beneath.

It will be noted that the steps 26 in the walls extend outwardly by a greater distance than the thickness of the walls at the top. Thus the upright wall portions 28 are spaced from the adjacent walls of the container nested therein. This facilitates denesting. This is also aided by the pillars 38 at the corners. (In the nested state, the pillars 38 abut the rim bead 30 of the container 10 below).

The containers may be provided with snap-on lids. FIG. 4 shows lids 46 of a preferred type. It will be seen that each lid 46 has the form of a shallow tray with a periphal wall portion 48 of U-section, providing a channel 50 which opens downwardly. The width of the channel 50 is such that it can receive the rim bead 30 at the top of the wall of a container 10. The outer arm of the "U" has an internally projecting rib 52. This narrows the channel 50 to less than the width of the rim bead 30. Thus, as seen in FIG. 4, a lid 46 can snap-fit onto a container, the inherent flexibility of the lid's wall portion 48 allowing the rim bead 30 to be forced past the rib 52 and retained there.

The U-sectioned peripheral wall portion 48 is connected to the base 54 of the lid by an angled wall portion 56 and a short upright portion 58. The U-sectioned portion 48 has at its upper inner region a bevelled surface 60 which is complementary to the angled wall portion 56. Each lid may have strengthening ribs 62. (These may extend inwardly and be bevelled towards the surface of the base 54. This allows a card label to be placed on the ribs 62 and held in position by a film which is shrink-wrapped around the filled, sealed and labelled container. The card may be just below the full height of the wall portion 48.

As seen in FIG. 4, the lids are nestable. An upper lid 46' has its short upright portions 58 which nest freely within the peripheral wall portions 48 of a lower lid 46. The angled wall portion 56 of lid 46' rests on the bevelled surface 60; and the free edge of the U-sectioned portion 48 rests on the upper outer surface of the wall portion 48 of the lower lid 46. The base 54 of the upper lid 46' rests on the upper surfaces of the ribs 52 of the lower lid 46. The lids 46 may be injection moulded from a plastics material, like the containers 10.

Each container 10 may have, in addition to the standing lugs 40 at the end remote from the handle 22, a similar series of lugs 70 at the handle end. As shown in FIG. 6, the presence of the two sets of lugs 40,70 enables containers 10 to be stacked without nesting, by turning alternate containers through 90°. This may be useful when the containers 10 have been filled with (e.g.) paint, and lids 46 have been fitted.

The other function of the lugs 40 remote from the handle 22 is to enable the container to stand on end, resting on the side surfaces 44 of the lugs and on the upper portion of the wall 14.

Of course, the skilled man will appreciate that the containers must be so dimensioned that there are appropriate clearances to enable nesting. Plainly a much larger clearance is required at the handle end. The dimensions of the lugs 40,70 will also affect the necessary clearances.

Figure 9:
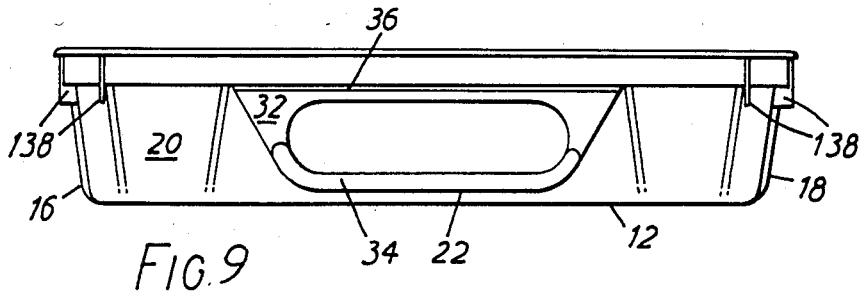
FIGS. 9 and 10 are views similar to those in FIGS. 2 and 5 respectively but showing a second embodiment.
Figure 10:
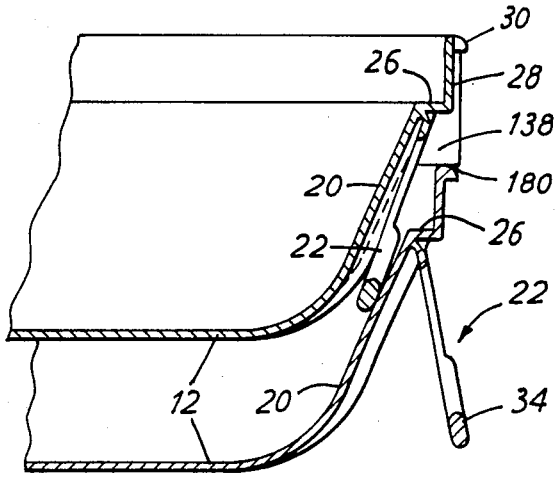
Figure 11:
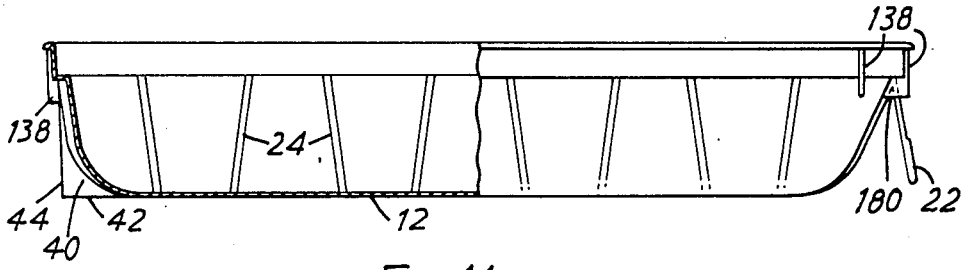
FIG. 11 is a longitudinal elevational half-section of the second embodiment.

FIGS. 9 to 11 show a second embodiment. This too is a plastics paint container, with most features as described for the first embodiment. Like elements bear like reference numbers. There are two main differences: the standing lugs, and the corner formations.

The lugs 40 of the first embodiment are quite small, and so their side surfaces 44 are substantially spaced inwardly from the outer edge of the rim bead 30. Thus when the container 10 is stood on end, it stands at an angle, leaning backwards, and tends to be unstable.

The container 110, as seen in FIG. 11, has much larger lugs 40, the surfaces 42,44 being at an approximate right angle, defining planes which embrace the container 110 beneath the step 26. The side surfaces 44 are nearly in line with the outside of the rim bead 30. Thus the container can be stood almost vertically.

The large lugs 40 affect the nesting. It is not practicable for the containers 110 to nest so deeply as is the case with the previously described containers 10. Therefore they are provided with corner formations which support them in the configuration shown in FIG. 10. In the first embodiment there is a single pillar 38 on each corner, extending downwardly only for the length of the wall portion 28. In the second embodiment this is replaced by a pair of upright ribs 138. Each rib 138 comprises a web portion extending approximately perpendicularly away from a wall 14,16,18 or 20 just before the rounding of a corner. Thus the ribs of each pair are approximately perpendicular to each other. The ribs 138 extend downwardly some way beneath the upper wall portions 28, and are integral with respective walls throughout their length. At the bottom, each rib 138 terminates with a downwardly facing support surface 180. As seen in FIG. 10, the ribs 138 are dimensioned so that containers 110 nest with the support surfaces 180 of the eight ribs of each container resting on the rim bead 30 of the container beneath; and this causes a mutual spacing of the container 110 sufficient to accommodate the lugs 40 (and the handle 22 in its nesting configuration).

The use of a pair of ribs 138 at each corner spreads the load when the empty containers are stacked.

Preferably the inner dimensions of the container are such as to receive a paint roller applicator.

While preferred embodiments of the invention have been described, it will be appreciated that much variation is possible. The upper portions of the walls 14,16,18,20 of the container 10 could have different formations from those (26,28,30) described above. For example, instead of a solid rim bead 30, the upper margins of the walls could be curved over or flanged. A container with large standing lugs (as in the second embodiment) could have corner pillars, as in the first embodiment, but extending lower, instead (or as well) as ribs 138. A small-lugged container could have pairs of ribs analogous to the ribs 138 (but probably shorter, like the pillars 38). The handle 22 could be connected to the container adjacent the junction of the wall 20 and the base 12, instead of at an upper region of the wall 20. It would then extend upwardly and/or outwardly.

We have described a lid having short ribs 62 on its peripheral wall portion 48. Alternatively, the ribs may extend right across the length and width of the lid to form a grid. This can give a lid of considerable strength and rigidity, on which a card label can be seated very positively. Of course, the utility of this general type of lid (having a peripheral wall shaped to define a downwardly open channel shaped so as to receive the rim of a container, preferably with a snap fit, the peripheral wall being also shaped so that lids are stackable with the wall of one engaging the channel of the next; and preferably with strengthening ribs extending from the peripheral wall at least a part of the way across the lid) is not restricted to containers as described herein.

These and other variations will readily occur to the skilled man.

I claim:

1. A nestable unitary molded plastics container comprising: a base portion; a side wall portion extending upwardly from the perimeter of the base portion; and a carrying handle portion connected to said wall portion by a resilient hinge permitting said handle portion to be displaceable between a carrying configuration in which said handle extends outwardly away from said wall portion, and a nesting configuration in which said handle portion lies adjacent to the exterior of said wall portion so that the container is nestable within a like container with said handle portion of the inner container extending within the outer container.

2. A container as in claim 1 wherein said wall portion is formed with a downwardly facing support surface adjacent its upper edge but spaced therefrom, which abuts the upper edge of the wall portion of a lower container when nesting.

3. A container as in claim 2 wherein the support surface is provided at least in part by an outward step in said wall portion on the outside of said wall portion.

4. A container as in claim 2 wherein the support surface is provided at least in part by a plurality of projections on the outside of said wall portion.

5. A container as in claim 1 wherein said wall portion extends upwardly and outwardly from the base portion in the normal orientation and lugs are provided adjacent the region of connection of the base and wall portions to enable the container to stand on end, supported by the lugs and by an upper region of said wall portion.

6. A container as in claim 1, the inner dimensions of which are such that the container can receive a paint roller applicator.

7. A container as in claim 1 wherein said handle portion is integrally formed with said wall portion and wherein said resilient hinge is formed by a line of weakness in the plastics material, the container further including a lid which has a peripheral channel engageable over a complementary upper margin of said wall portion so as to be snap-engageable over said margin, said lid being in the form of a shallow tray having a base and strengthening ribs projecting above the base and a display card in the tray supported on the upper surfaces of the ribs.

* * * * *